US009743768B2

(12) United States Patent
Hollenbeck

(10) Patent No.: US 9,743,768 B2
(45) Date of Patent: Aug. 29, 2017

(54) CABINET INSTALLATION SPACER AND RETAINER

(71) Applicant: H4 Innovations, LLC, Fox Point, WI (US)

(72) Inventor: Brian Dean Hollenbeck, Fox Point, WI (US)

(73) Assignee: H4 Innovations, LLC, Fox Point, WI (US)

( * ) Notice: Subject to any disclaimer, the term of this patent is extended or adjusted under 35 U.S.C. 154(b) by 25 days.

(21) Appl. No.: 14/619,230

(22) Filed: Feb. 11, 2015

(65) Prior Publication Data

US 2015/0223604 A1 Aug. 13, 2015

Related U.S. Application Data

(60) Provisional application No. 61/938,145, filed on Feb. 11, 2014.

(51) Int. Cl.

| | |
|---|---|
| ***F16B 17/00*** | (2006.01) |
| ***A47B 97/00*** | (2006.01) |
| ***A47B 87/00*** | (2006.01) |

(52) U.S. Cl.

CPC ..... *A47B 97/00* (2013.01); *A47B 87/008* (2013.01); *Y10T 403/70* (2015.01)

(58) Field of Classification Search

CPC ... Y10T 403/16; Y10T 403/66; Y10T 403/67; Y10T 403/70; Y10T 403/7001; A47B 87/008; A47B 97/00; E04D 5/148

USPC ..... 403/11, 341, 342, 345, 346; 52/749.11; 312/263, 264, 265, 265.5

See application file for complete search history.

(56) References Cited

U.S. PATENT DOCUMENTS

| | | | | |
|---|---|---|---|---|
| 1,349,458 | A * | 8/1920 | Johnson | F26B 25/18 108/52.1 |
| 3,577,973 | A * | 5/1971 | Katona | E06B 3/6621 126/200 |
| 3,581,681 | A * | 6/1971 | Newton | B65D 19/0018 108/57.28 |
| 5,544,465 | A * | 8/1996 | Hood | E04C 2/54 52/786.11 |
| 7,571,577 | B2 * | 8/2009 | Nanayakkara | E04H 9/10 14/73.5 |
| 8,076,574 | B2 * | 12/2011 | Irmer | H02B 1/308 174/17 R |
| 8,579,389 | B1 * | 11/2013 | Kuo | H05K 7/1488 312/111 |
| 9,328,518 | B2 * | 5/2016 | Bilge | E04F 13/0805 |
| 2012/0090156 | A1 * | 4/2012 | Jackson | F16B 12/26 29/525.01 |
| 2013/0236243 | A1 * | 9/2013 | Personette | A47B 47/0025 403/345 |
| 2014/0007526 | A1 * | 1/2014 | Wright | E04F 15/02183 52/127.4 |
| 2014/0228886 | A1 * | 8/2014 | Aflatoon | A61B 17/7065 606/249 |

(Continued)

*Primary Examiner* — Gregory Binda
*Assistant Examiner* — Nahid Amiri
(74) *Attorney, Agent, or Firm* — Brian G. Gilpin; Godfrey & Kahn, S.C.

(57) ABSTRACT

A spacer adapted to be used with cabinet installation includes a spacer block connected to a support wall. The spacer block is adapted to be positioned so that the support wall is placed over a wall edge and the spacer block is placed between a pair of cabinet walls.

9 Claims, 6 Drawing Sheets

(56) References Cited

U.S. PATENT DOCUMENTS

2014/0270932 A1* 9/2014 Tseng ..... A47C 3/00
403/345

* cited by examiner

CABINET INSTALLATION SPACER AND RETAINER

CROSS REFERENCE TO RELATED APPLICATION

This application claims the benefit of U.S. Provisional Patent Application Ser. No. 61/938,145, filed Feb. 11, 2014, the disclosure of which is hereby incorporated by reference herein in its entirety for all purposes.

FIELD OF THE INVENTION

The present invention relates to spacers and retainers used in installing cabinets.

BACKGROUND

A pair of cabinets is usually connected to each other by screwing them together to make sure they are square relative to each other. This is done by using a clamp, either a standard clamp or a specialized cabinet clamp, to hold them together, and then by drilling anywhere from 2 to 4 holes in the sides of the stile forming one of the cabinet faceplates through to a stile of the other cabinet faceplate. A countersink bit is then used to make a shallow countersink hole 15 (see FIG. 2) in the side of the stile. Then a wood screw is screwed into the holes made in the stile.

After connecting the front of the cabinets to each other, the rear of the cabinets need to be connected together, so the cabinets as a single unit can be positioned in place. The rear of the cabinets are formed by a pair of spaced apart walls, with each of the walls received at its respective front end in a grove in the faceplate stile, spaced apart from the faceplate edge. As a result, the walls are spaced apart from each other at their rear edges as well. In order for the cabinets to be square relative to each other, the spacing between the walls at the front of the cabinets needs to be maintained at the rear of the cabinets. In order to obtain the desired spacing, wood shims 17 (see FIG. 3) are placed between the walls in order to get the space between the walls the same as the spacing between the walls at the front of the cabinets. A screw is then screwed through the walls and the shims to secure the walls and the shims together. Then anywhere from 4 to 8 screws are used to complete the connection. Lastly, the connected cabinets are screwed to a wall to complete the cabinet set installation. If more than two cabinets are to be installed, as is usually the case, then this process is repeated until all the cabinets have been installed.

This process of countersinking, shimming and installing of wood screws is time consuming, and can result in damage to the cabinets. Cabinets have been ruined because of the holes that have to be drilled through the stiles. The stiles are typically made of real wood, and if a pilot hole isn't deep enough, the screw can break after beginning to screw the cabinets together. If the screw breaks, the head comes off, and there is not a solid connection of the cabinets. This requires that another hole be drilled to make sure the cabinets are connected securely.

It is therefore be desirable to reduce the time needed to connect a pair of cabinets to each other, and to reduce the amount of screws needed to make the connection, thereby reducing the possibility of damage to the cabinets.

SUMMARY

This present invention provides a spacer adapted to be use with a pair of cabinets, each cabinet having a faceplate with a faceplate edge, and a wall groove spaced apart from the faceplate edge, with the pair of cabinets being positioned side by side with the faceplate edge of one faceplate being adjacent the faceplate edge of the other faceplate. The pair of cabinets also includes at least two walls, with each wall having a wall edge received in a respective faceplate wall groove. The spacer includes a spacer block connected to a support wall, the spacer block being adapted to be positioned so that the support wall is placed over a wall edge, so that the spacer block is placed between the pair of cabinet walls. More particularly, the spacer includes a thick spacer block connected to a thin support wall.

It will be understood by those skilled in the art that one or more aspects of this invention can meet certain objectives, while one or more other aspects can lead to certain other objectives. Other objects, features, benefits and advantages of the present invention will be apparent in this summary and descriptions of the disclosed embodiment, and will be readily apparent to those skilled in the art. Such objects, features, benefits and advantages will be apparent from the above as taken in conjunction with the accompanying figures and all reasonable inferences to be drawn therefrom.

DETAILED DESCRIPTION

Figure 1:
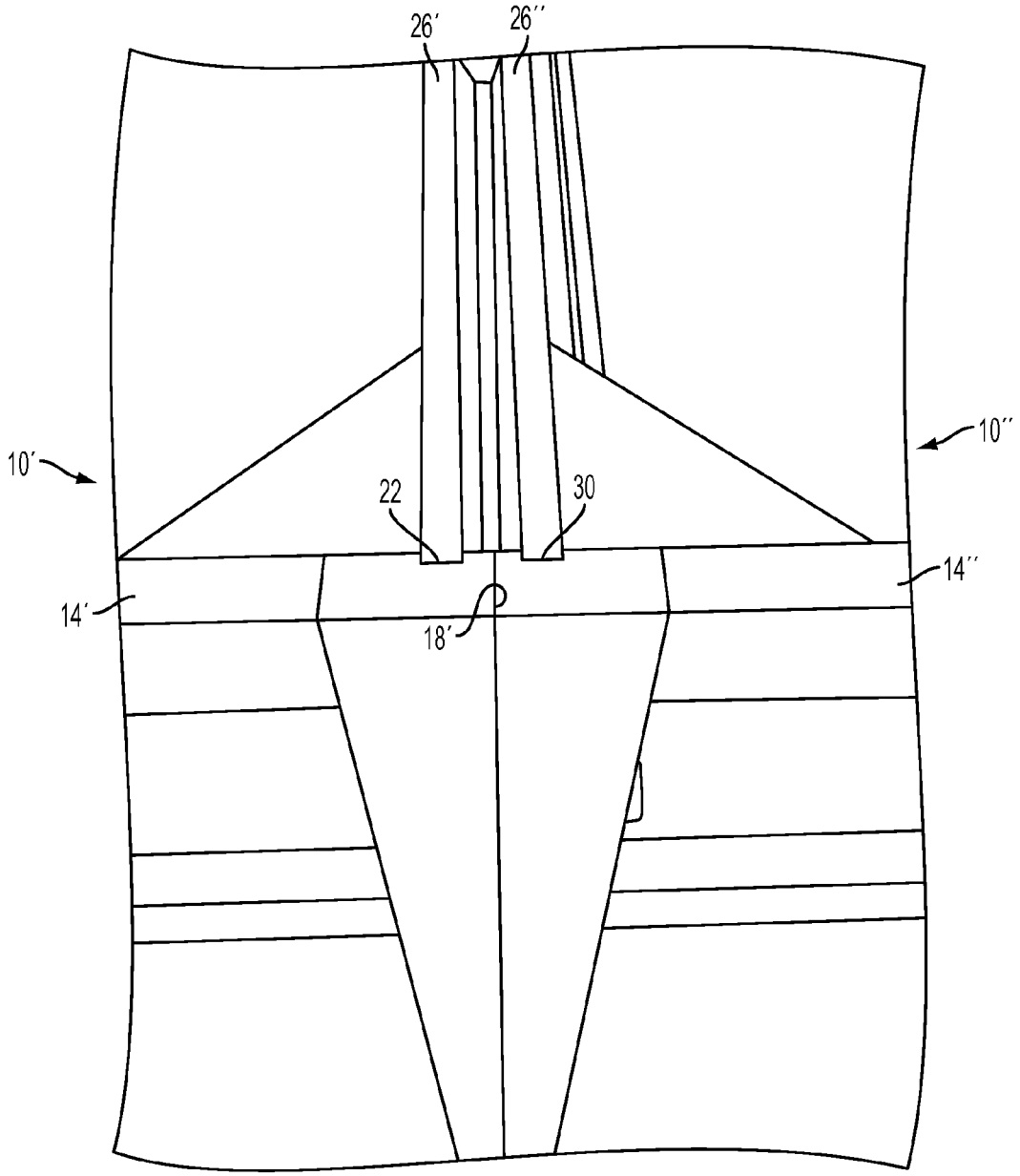
FIG. 1 PRIOR ART
FIG. 1 is perspective top view of a pair of cabinets, with two faceplates positioned adjacent one another as is known in the prior art.
Figure 2:
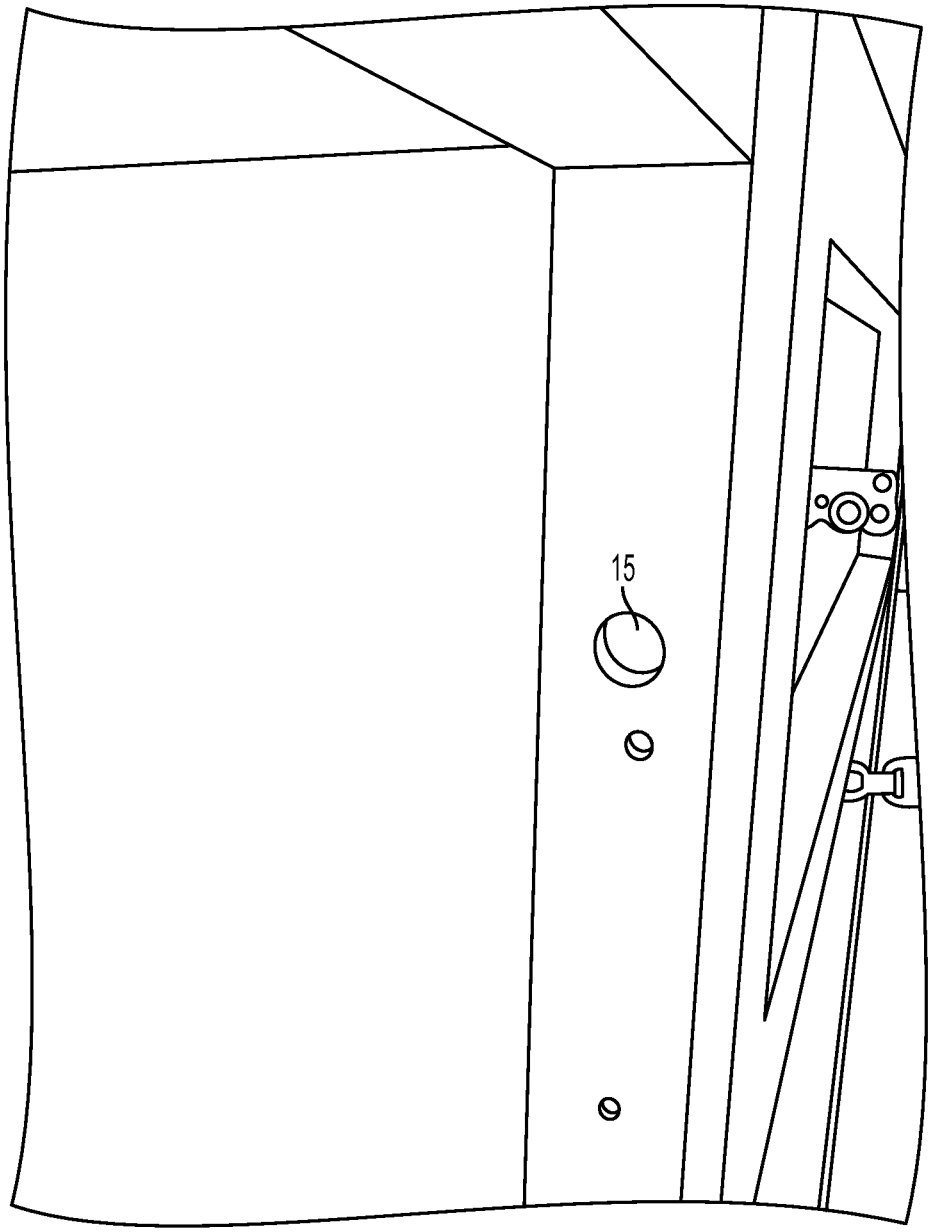
FIG. 2 PRIOR ART
FIG. 2 is a perspective side view of one of the stiles forming one of the openings of the two cabinets, illustrating how, in the prior art, holes needed to be drilled in the stiles.
Figure 3:
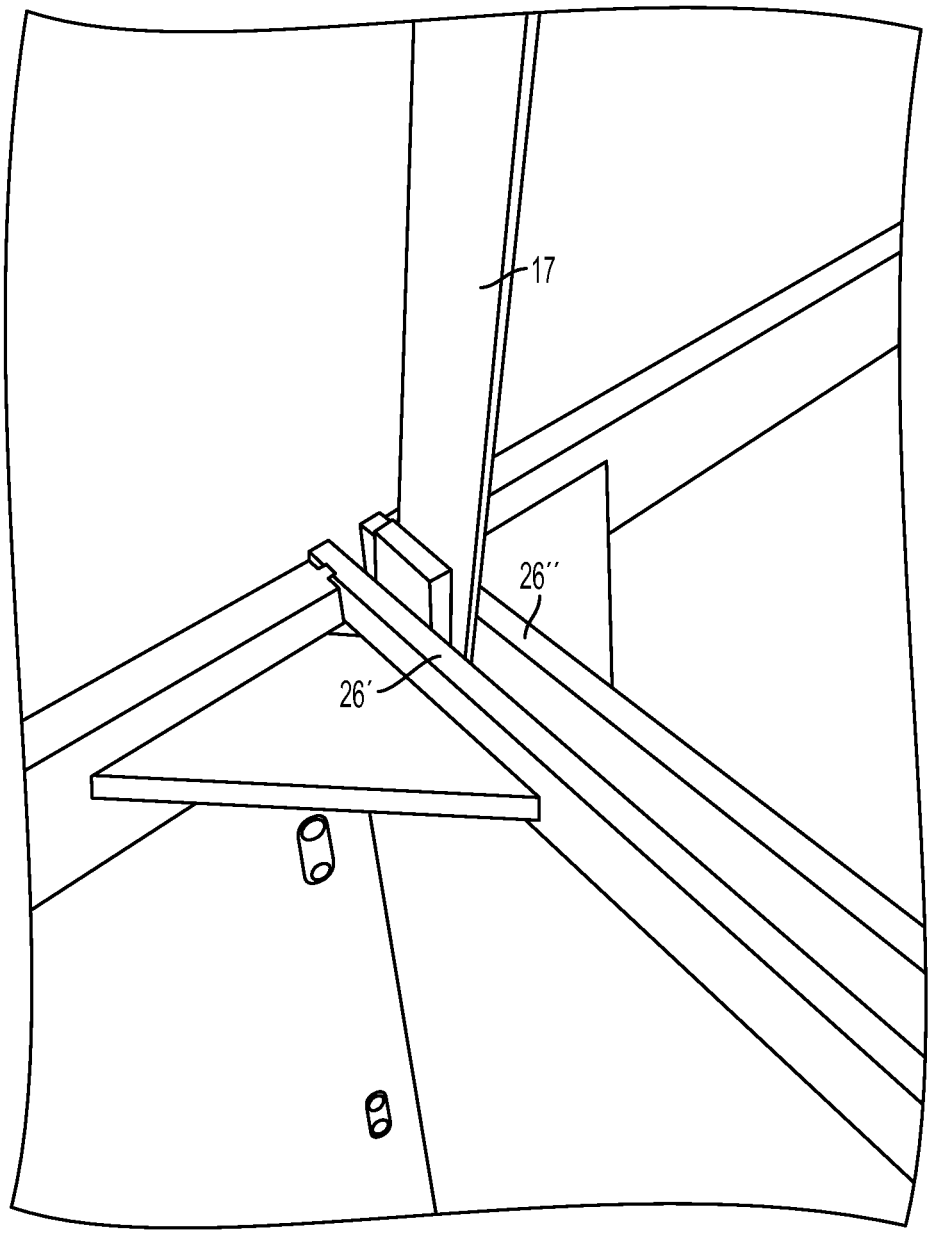
FIG. 3 PRIOR ART
FIG. 3 is a top perspective view of the rear of the two cabinets shown in FIG. 1, showing the spacing between two cabinet walls, and the prior art approach to obtaining proper spacing by using wood shims.

FIG. 1 illustrates a pair of cabinets 10, with each cabinet 10' and 10" having a faceplate 14 with a faceplate edge 18, and a wall groove 22 spaced apart from the faceplate edge 18, with the pair of cabinets being positioned side by side with the right faceplate edge 18' of one faceplate being adjacent the left faceplate edge 18" of the other faceplate. And as further shown in FIG. 1, the pair of cabinets has at least two walls 26' and 26", with each wall 26 having a wall edge 30 received in a respective faceplate wall groove 22.

FIGS. 4 to 7 illustrate a spacer 100 adapted to be used with this pair of cabinets 10, the spacer 100 including a spacer block 104 connected to a support wall 108, the spacer block 104 being adapted to be positioned, as shown in FIGS. 4 to 7, so that the support wall 108 is placed over a top wall edge 34, so that the spacer block 100 is placed between the pair of cabinet walls 26' and 26".

Figure 4:
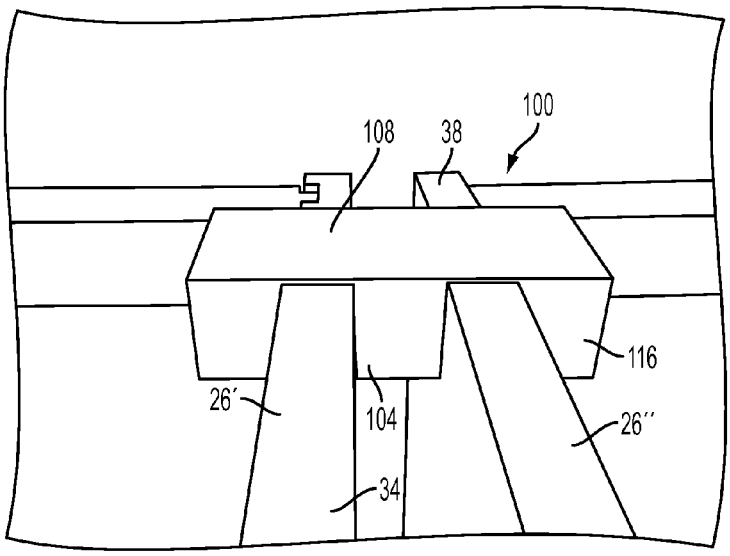
FIG. 4 is a top perspective view of the rear of two cabinets showing the walls spaced apart and held in place by one embodiment of a spacer in accordance with the invention.
Figure 5:
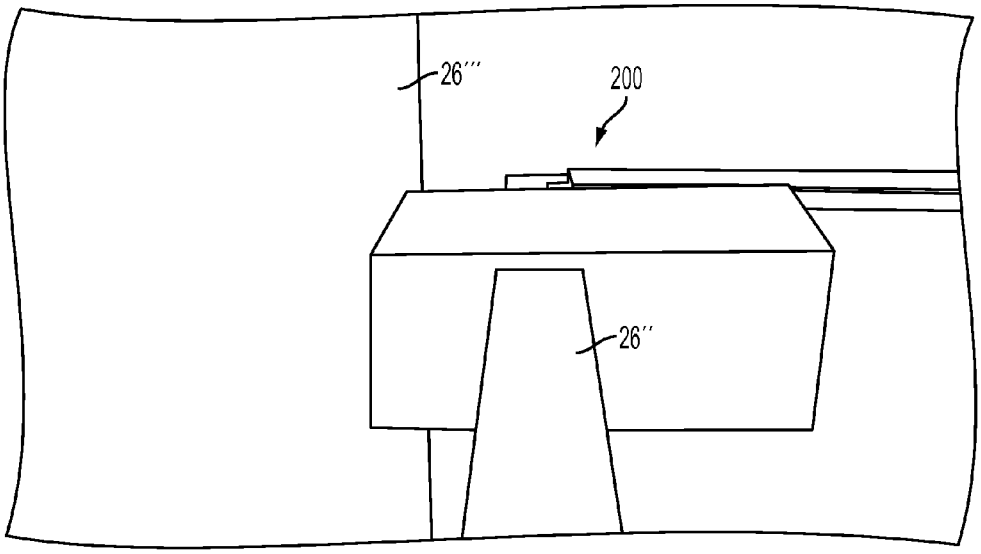
FIG. 5 is a top perspective view of two adjacent cabinets, with one wall being shorter than the other, with an alternate embodiment of a spacer according to the invention positioned over the shorter wall and providing proper spacing between the shorter wall and the taller wall.

More particularly, the spacer 100 includes the first thick spacer block 104 connected to the thin support wall 108. In one application, as shown in FIGS. 4 and 5, the spacer 100 is used near a rear wall edge 38 opposite the forward wall edge 30 received in the faceplate groove 22. The spacer 100 further includes a second thick spacer block 112 spaced apart from the first thick spacer block 104, and connected to the thin support wall 108, as illustrated in FIGS. 4 and 5. The support wall 108 is thin in order to reduce the amount of dimension it adds to the top or bottom of the cabinet wall, for its sole purpose is to maintain the proper spacing between the spacer blocks. But in other embodiments, other thicknesses can be used.

Figure 6:
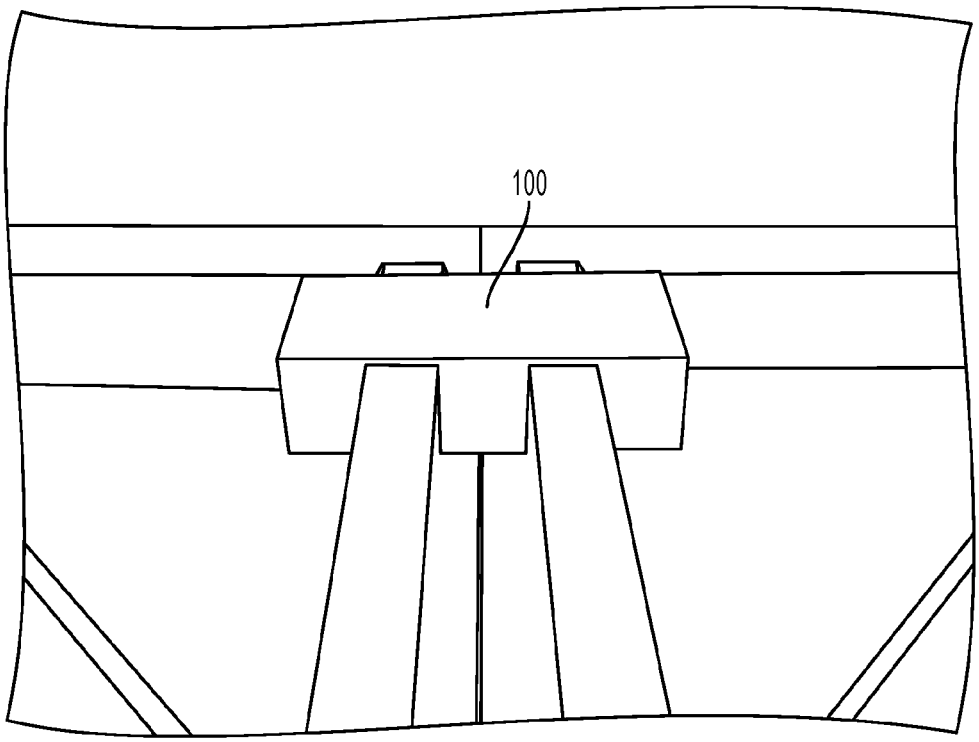
FIG. 6 is a top perspective view of the spacer of FIG. 4, the spacer being used as a retainer to hold the faceplates of two cabinets in adjacent position.
Figure 7:
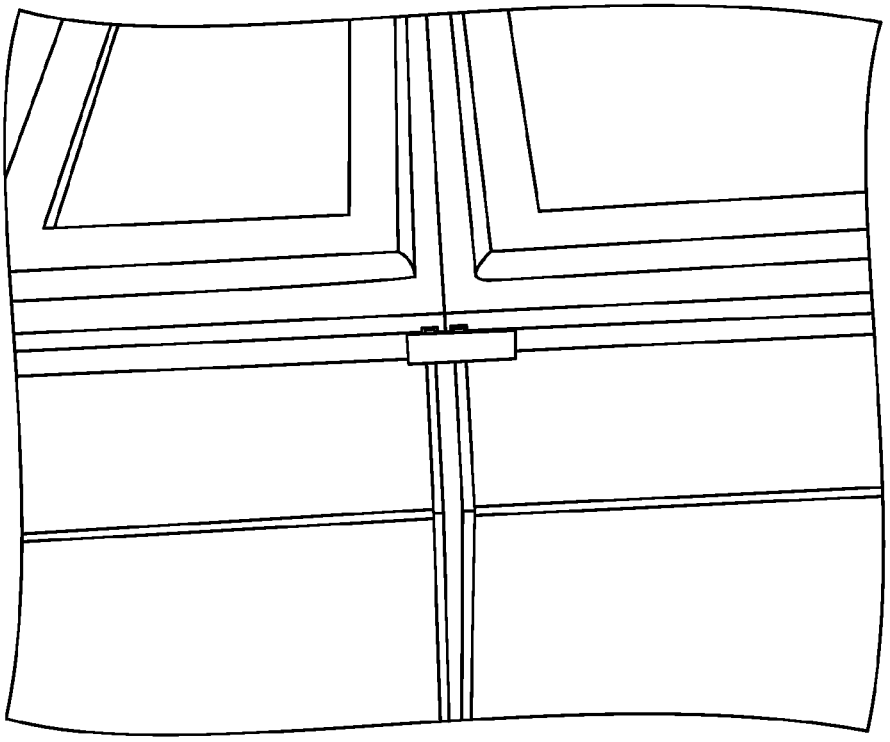
FIG. 7 is bottom perspective view of the front of two adjacent cabinets, with the spacer of FIG. 4 used to hold the adjacent faceplates in their adjacent position.

In the embodiment illustrated in FIGS. 4 and 6 and 7, the spacer 100 further includes a third thick spacer block 116 spaced apart from the first thick spacer block 104, and connected to the thin support wall 108, with the first thick spacer block 104 being located inside between the pair of walls 26' and 26", and the second and third thick spacer blocks being placed on the respective outsides of the walls so that the spacer 100 serves as a retainer to hold the walls 26' and 26" in their spaced apart positions. More particularly, the spacer 100 is placed on the walls near the forward wall edge received in the wall groove 22, as shown in FIG. 6, in order to act as a retainer to hold the two faceplates together 14' and 14". FIG. 7 illustrates the spacer 100 serving the same function at the bottom of the side by side cabinets.

Figure 8:
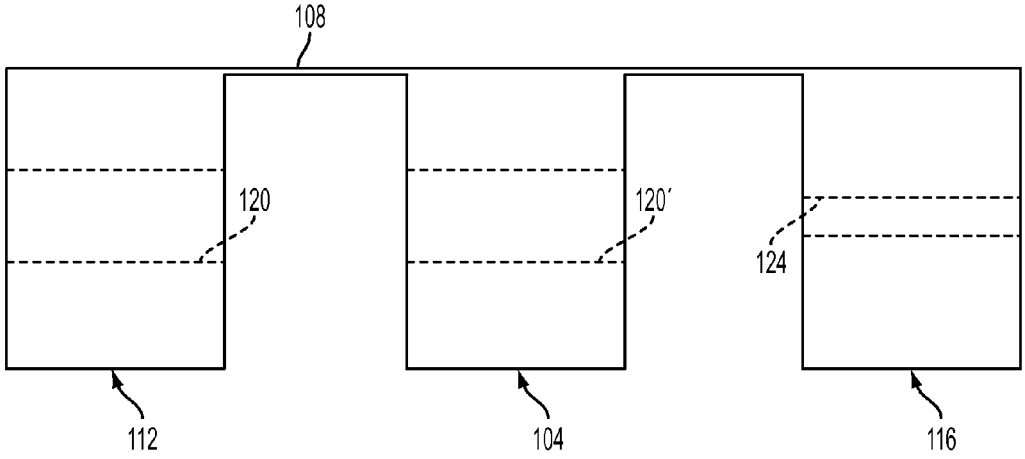
FIG. 8 is an enlarged side view of the spacer shown in FIG. 4, illustrating in ghost a through hole through a second spacer block, and the middle or a first spacer block, and a smaller diameter through hole through a third spacer block.

To aid in the assembly of the cabinets 10, and to secure the spacer 100 to the cabinet walls 26, the second thick spacer block 112 has a hole 120 (see FIG. 8) along a central axis of the second thick spacer block 112 extending parallel to the thin support wall 108, and perpendicular to the cabinet wall 26. In the illustrated embodiment, the second thick spacer block hole is a through hole. Further, the third thick spacer block 116 also has a hole 124 along a central axis of the third thick spacer block extending parallel to the thin support wall 108, and perpendicular to the cabinet wall 26. The second thick spacer block hole 124 has a diameter of ¼" in the illustrated embodiment, and the third thick spacer block hole has a diameter which is smaller than the diameter of the second thick spacer block, a diameter of ⅛" in the illustrated embodiment. In other embodiments, other dimensions can be used.

The cabinet spacer 100 can be made of any material, and can be made with any size thick spacer block, and any size spacing between the blocks. Most cabinets come with either ½", ⅜", or ¾" walls, so the spacing between the second and first thick spacer blocks, and between the third and first thick spacer blocks, would be of one of these three dimensions. And the spacing between walls is usually ½", so the width of the first spacer block would be slightly less than this dimension, or about 15⁄32". The height and depth of the block are chosen so that a screw can extend easily through the blocks, as described further below. In the illustrated embodiment, the height is 21⁄32", and the depth is 1", but any reasonable dimension can be used. For example, if the end blocks are each ½" and the middle block is 7⁄16", the measurement between the inside of each of the outer blocks would be 1.5".

In the illustrated embodiment, the spacer 100 is made from plastic, and the spacer is made by either having injection molding, or by starting with a plastic blank of ½" thickness, and then cutting out the notches between the spacer blocks. After the spacer has been produced, holes are drilled in the spacer blocks, as further described below. The spacer is also designed so that it acts as a whole complete piece once installed, to ensure rigidity. Although the thin support wall and the spacer blocks are illustrated as an integral unit, in other embodiments (now shown), they can be separate pieces connected together using any suitable method, such as by nailing or gluing the pieces together.

In order to aid an installer in securing the spacer in place, and in securing the cabinet walls to the spacer, the holes 100 and 124 are made in the spacer blocks, perpendicular to the plane of the walls. With the first spacer block between the walls, and the other spacer blocks outside the walls, it is desirable to let an installer place a wood screw loosely in one block before then screwing the wood screw through one wall, and then through the second wall, the first block and into the other outside block. This aids the installer by holding the wood screw in its proper position prior to its installation. To this end, the outside third block and the middle or first block have a larger diameter hole 120 and 120' to loosely hold a wood screw (not shown), and the other outside second block has a smaller diameter hole 124 to receive and hold the wood screw, while at the same time limiting the likelihood of any splitting occurring by virtue of the smaller diameter pilot hole.

This cabinet installation spacer 100 allows an installer to save time and not have to use wood shims to get proper spacing. Further, one cabinet spacer 100 can be used at the top of the cabinet towards the front of the cabinet to secure the fronts of the cabinets together. Another spacer can be used at the underneath part of the front of the cabinets, located above the toe-kick area, to also secure the fronts of the cabinets together. Then two cabinet spacers will be used on the backs of the cabinets, at the top and bottom, to make sure the cabinets are square and secured together, before attaching the connected cabinets to a wall. Additional spacers are then used in this same fashion to connect the next cabinet to this set, until all cabinets have been added to the set.

A two spacer block spacer 200, as shown in FIG. 5, can be used when one cabinet wall 26''' is taller than the other cabinet wall 26"; in such cases like where a 15" cabinet is being installed next to a 30" cabinet, which is common for a cabinet located above a stove or refrigerator. This spacer 200 will be used at the bottom of the cabinet. The two piece spacer 200 will allow for the exact ½" needed between the cabinets and will also allow for a screw to pass right through it and grab the side wall of the taller cabinet to help secure them together. The three spacer block cabinet spacer 100, as shown in FIGS. 4, 6 and 7, will be used on the tops of these cabinets as they will still align at the same height.

The cabinet installation spacer 100 allows installers to save time on installing cabinets, as well as minimize the damage to cabinets with having to drill through the fronts (stiles). The cabinet spacer 100 also allows for cabinet installers to more easily install cabinets. And the spacer 100 eliminates the step of screwing through the front of the cabinets at the stiles.

Although the invention has been herein described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein.

What is claimed is:

1. A cabinet spacer used with a pair of cabinets comprising:

first and second cabinets, each cabinet having a faceplate with a faceplate edge and a wall groove spaced apart from the faceplate edge, each cabinet having at least two walls with each wall having a wall edge received in a faceplate wall groove, the pair of cabinets positioned side by side with the faceplate edge of the faceplate of the first cabinet being adjacent the faceplate edge of the faceplate of the second cabinet, and a spacer formed by a spacer block connected to a support wall, the spacer configured to be selectively positionable such that when the support wall is placed over a wall edge, the spacer block is positioned between the pair of cabinet walls.

2. A cabinet spacer used with a pair of cabinets comprising:

first and second cabinets, each cabinet having a faceplate with a faceplate edge and a wall groove spaced apart from the faceplate edge, each cabinet having at least two spaced apart walls with each wall having a wall edge received in a faceplate wall groove, the pair of cabinets positioned side by side with the faceplate edge of the faceplate of the first cabinet being adjacent the faceplate edge of the faceplate of the second cabinet, and a spacer formed by a thick spacer block connected to a thin support wall, the spacer configured to be selectively positionable over the wall edge such that when the thin support wall of the spacer is placed over the wall edge, the thick spacer block is placed between the pair of cabinet walls near an end of the wall edge opposite the wall edge received in the faceplate groove.

3. The cabinet spacer used with a pair of cabinets according to claim 2 wherein the spacer further includes a second thick spacer block spaced apart from the thick spacer block and connected to the thin support wall.

4. The cabinet spacer used with a pair of cabinets according to claim 3 wherein the spacer further includes a third thick spacer block spaced apart from the thick spacer block and connected to the thin support wall, wherein when the thick spacer block is positioned between the pair of cabinet walls, the second and third thick spacer blocks are positioned on outside of each cabinet wall so that the spacer serves to hold the cabinet walls in spaced apart positions.

5. The cabinet spacer used with a pair of cabinets according to claim 4 wherein the second thick spacer block has a hole along a central axis of the second thick spacer block extending parallel to the thin support wall.

6. The cabinet spacer used with a pair of cabinets according to claim 5 wherein the second thick spacer block hole is a through hole.

7. The cabinet spacer used with a pair of cabinets according to claim 6 wherein the third thick spacer block has a hole along a central axis of the third thick spacer block extending parallel to the thin support wall.

8. The cabinet spacer used with a pair of cabinets according to claim 7 wherein the second thick spacer block hole has a diameter, and the third thick spacer block hole has a diameter which is smaller than the diameter of the second thick spacer block.

9. The cabinet spacer used with a pair of cabinets according to claim 8 wherein the thick spacer block has a hole with a diameter larger than the diameter of the hole in the third thick spacer block.

* * * * *